United States Patent [19]

Heeren et al.

[11] Patent Number: 4,603,734

[45] Date of Patent: Aug. 5, 1986

[54] HEAT EXCHANGE ELEMENT OF THE AIR-TUBE TYPE

[75] Inventors: Hermann Heeren; Wilhelm Wendel, both of Nuremberg, Fed. Rep. of Germany

[73] Assignee: M.A.N. Maschinenfabrik Augsburg-Nürnberg Aktiengesellschaft, Nuremberg, Fed. Rep. of Germany

[21] Appl. No.: 698,933

[22] Filed: Feb. 7, 1985

[30] Foreign Application Priority Data

Feb. 8, 1984 [DE] Fed. Rep. of Germany ..... 3404376

[51] Int. Cl.[4] ..... F28F 9/00

[52] U.S. Cl. ..... 165/67; 165/83; 165/148; 165/900

[58] Field of Search ..... 165/81, 82, 83, 148, 165/68, 67

[56] References Cited

U.S. PATENT DOCUMENTS

| | | | |
|---|---|---|---|
| 1,608,736 | 11/1926 | Haas et al. | 165/148 |
| 1,794,135 | 2/1931 | Bancel | 165/68 |
| 1,894,279 | 1/1933 | Meyer | 165/82 |
| 2,468,903 | 5/1949 | Villiger | 165/81 X |
| 3,208,438 | 9/1965 | White | 165/81 X |

*Primary Examiner*—William R. Cline
*Assistant Examiner*—Richard R. Cole
*Attorney, Agent, or Firm*—Becker & Becker, Inc.

[57] ABSTRACT

A heat exchange element of the air-tube type for a heat exchanger unit. The heat exchange elements are connected via flexible connecting lines with the liquid supply and withdrawal channels, which are separated from the heat exchange elements. Together with these channels, the elements are supported on a support structure which has a relatively large open support interval. The heat exchange elements have a relatively short dimension in the longitudinal direction of the tubes through which the air flows. So that no tension forces occur at the transition surfaces between the elements and the walls of the liquid supply and withdrawal channels, the top and bottom surfaces of the heat exchange elements are curved in a dish-shaped manner.

2 Claims, 3 Drawing Figures

Z
Z
3
1
2a
2b
LRT-ELEMENT
2a
2b 12
13
4
1

11
9a
8
3
LRT-ELEMENT
8
9a
5
6
9b
9b
10
10

8
6
7
9
8

3
6

HEAT EXCHANGE ELEMENT OF THE AIR-TUBE TYPE

BACKGROUND OF THE INVENTION

1. Field of the Invention

The present invention relates to heat exchange elements of the air-tube type for a heat exchanger unit; the heat exchange elements are connected via flexible connecting lines with the liquid supply and withdrawal channels, which are separated from the heat exchange elements. Together with the channels, the heat exchange elements are supported on a support structure having relatively large open support intervals. The heat exchange elements have a relatively short dimension, i.e. are not very wide, in the longitudinal direction of the tubes through which the air flows.

2. Description of the Prior Art

Heat exchange elements of the air-tube type have been known in theory for years as radiators in the automobile and aircraft industries, and also have even been used formerly to a certain extent. In such radiators, the ends of the otherwise round, light metal tubes are expanded into a multi-sided configuration, especially a hexagonal configuration, and are connected with one another in a leak proof manner in the region of the edges or side surfaces of the multi-sided configuration by means of hard soldering or the like. However, in practice such radiators have not been successfully used because the permanent sealing problems and corrosion problems could not be satisfactorily resolved; furthermore, the elements could not be economically produced.

In recent times, it has been proposed in publications to use heat exchange elements of the air-tube type in dry cooling towers. These air-tube-dry cooling elements, designated in this application as LRT-elements, for dry cooling towers, were optimized in that, with the exception of the tubes along the edges, the tube ends which were enlarged to the hexagonal configuration, and the presence of turbulancegenerating means, for example in the form of beads, transverse grooves, or the like, which are distributed over the active length of the tube, increased the heat transfer by the air. For economical reasons, an optimum tube length of between 0.6 m and 1 m, a tube thickness of from 0.4 to 0.5 mm, and a length of about 4 m and a width of about 3 m, which dimensions were determined by transportation conditions, were established.

The heretofore known LRT-elements have a box-shaped design (parallelepipidal, quadratic or squared shape) with planar walls. To facilitate removal of water and air, the elements were disposed at a slight incline. However, due to the weight of the liquid which flows around the tubes, and to the dead weight of the elements, tension forces resulted at the transition surfaces between the elements and the water supply and withdrawal channels; these tension forces had to be compensated for by expensive and complicated structural means. Furthermore, the expansion or deformation of the elements caused by temperature also had to be compensated for. If no specific structural measures, for example displaceability of the elements, are taken to compensate for this deformation, the latter leads to a downward deflection or bending of the elements, which have large, open support intervals. This bending, in turn, results in further tension forces at the transition surfaces to the water supply and withdrawal channels.

The previously unresolved permanent sealing and corrosion problems could be eliminated by selecting a suitable synthetic material in place of aluminum, brass, or a similar metal. However, the aforementioned drawbacks with regard to the occurrence of tension forces are particularly serious with LRT-elements of synthetic material because, as is well known, synthetic materials have a relatively great thermal expansion, for example 7 mm per m and 100° C. temperature difference, and, in comparison to metals, have a significantly poorer strength and inherent rigidity.

An object of the present invention is to improve heat exchange elements of the aforementioned general type such that no tension forces occur at the transition surfaces between the LRT-elements and the walls of the channels which serve for supply and withdrawal of liquid.

BRIEF DESCRIPTION OF THE DRAWING

This object, and other objects and advantages of the present invention, will appear more clearly from the following specification in conjunction with the schematically illustrated drawing, in which.

SUMMARY OF THE INVENTION

The heat exchange element of the present invention is characterized primarily in that the top and bottom surfaces or sides thereof are curved in an arch-shaped, dish-shaped, or dome-shaped manner.

In contrast to the heretofore known heat exchange elements, where tension forces are generated, only compressive forces are generated by the novel element shape at the transition surfaces to the water supply and withdrawal channels; these compressive forces can be readily absorbed without great difficulty. The dish shape also offers the possibility of absorbing the thermal expansion of the element by means of deformation of the dome itself. Furthermore, the inventive elements can be supported at the same height or level, since the dome shape is already an advantageous shape for removing water from and supplying air to and removing it from the element. In other words, the requirement for disposing the elements at an incline relative to the horizontal, as was necessary with the heretofore known parallelepipedal elements, is eliminated, so that when the inventive elements are disposed, on their support members, the tubes of the elements, through which the air flows, can extend substantially vertically and hence substantially normal to the top and bottom surfaces or sides of the element. Finally, the dome shape also increases the inherent rigidity of the inventive element.

DESCRIPTION OF PREFERRED EMBODIMENTS

Figure 1:
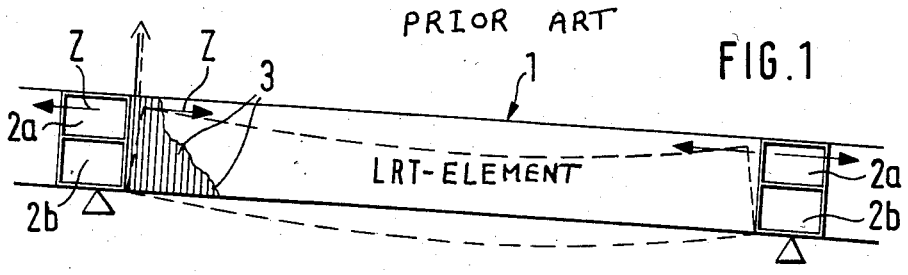
PRIOR ART FIG.1
FIG. 1 is a side view of a known LRT-element.

Referring now to the drawing in detail, in FIG. 1 the parallelepipedal, prior art LRT-element, which has planar (rectangular) surfaces is designated with the reference numeral 1. The LRT-element 1 is encircled by channels 2*a*, 2*b* which have a rectangular cross-section, and planar walls. These channels take care of the supply (2*a*) and the withdrawal (2*b*) of the liquid, especially water, which flows around the LRT-element tubes 3 through which air flows. The shape of the LRT-element when it expands or deforms is shown in dashed lines; in so doing, tension forces result at the transition surfaces to the liquid channels.

Figure 2:
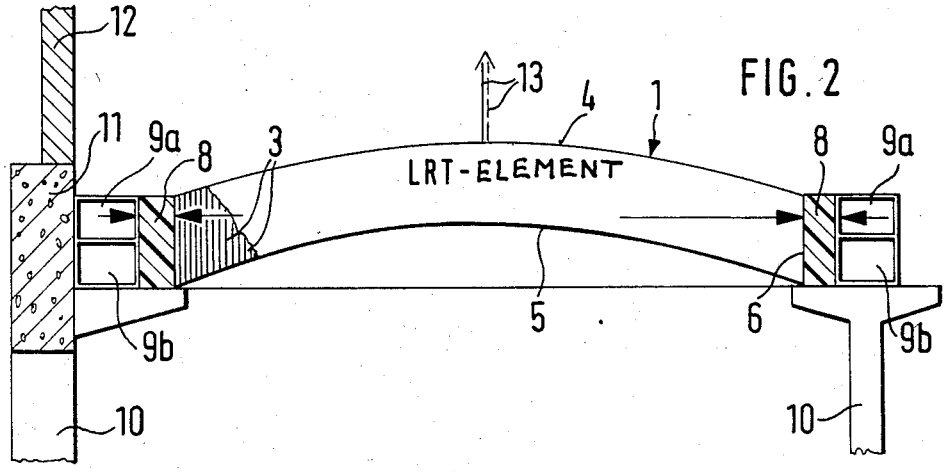
FIG. 2 is a side view of one inventive embodiment of an LRT-element which is installed in a dry cooling tower.
Figure 3:
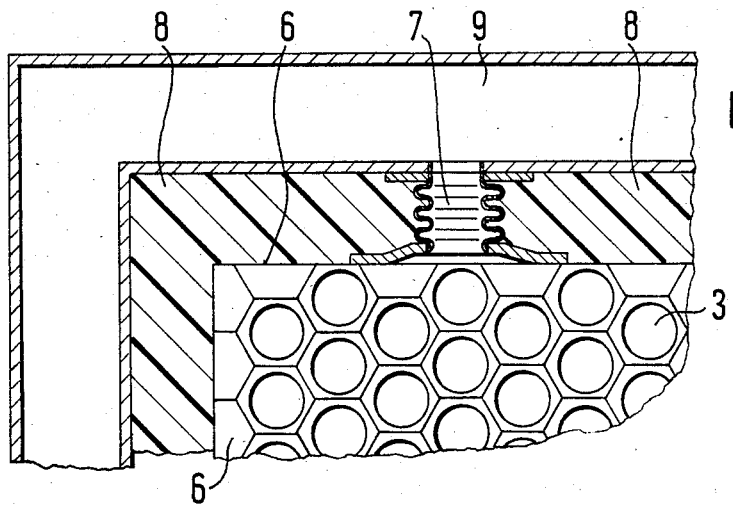
FIG. 3 is a partially sectioned enlarged plan view of the LRT-element of FIG. 2.

A shown in connection with the inventive LRT-element of FIG. 2, its top surface or side 4, and its bottom surface or side 5, which are formed by the thicknesses of the tube extensions, are dish-shaped, as defined in the illustrated side view by two convexly curved circular arcs. With the exception of where water is supplied and withdrawn, the side walls 6 of the LRT-elements are planar and uninterrupted. Except in the region of the flexible water supply and withdrawal passages 7, the LRT-elements are surrounded by an elastic layer 8 which entirely or partially compensates for the thermal expansion; this layer 8 is expediently made of an elastic synthetic material. The flexible water supply and withdrawal passages 7 communicate with appropriate openings in the side walls of the water supply and withdrawal channels 9*a* and 9*b*. The LRT-element, the water channels, and the intermediate layer are supported on the support structure which forms the lower portion of the cooling tower. Two support members 10 of this structure are indicated in FIG. 2. The support surfaces for the individual elements and the associated water channels are disposed at the same level or height. At the level of the LRT-elements, the outer shell of the cooling tower is in the form of a relatively thick concrete beam 11. The thinner tower shell 12 extends above the concrete beam 11.

The supply of air to and removal from the LRT-element is effected at the highest point of the dome, as indicated at the reference numeral 13.

The composition of an LRT-element itself is known. With the exception of the tubes along the edges, it comprises round, upright tubes, the ends of which are enlarged into a hexagonal or other multi-sided configuration, and which are connected with one another in the region of the corners or side surfaces of the multi-sided configuration in such a manner to be sealed relative to the liquid. With the exception of the transverse grooves for generating turbulence of the air which flows through the tubes, the tubes are not ribbed or finned. To form smooth, planar side walls, the latter are formed of tubes or rods which have a five-sided cross section extending over their entire length, and which are connected with one another, and with the adjacent tubes which are expanded into the hexagonal configuration, in a manner such that they are sealed relative to the liquid. Only at those locations in the side wall where supply and withdrawal of water is to be effected is a round tube having ends enlarged into a hexagonal configuration provided in place of the five-sided tube or rod.

It is also possible to eliminate the elastic intermediate layer between the LRT-element and the water supply and withdrawal channels. In such a case, the thermal expansion of the element is accommodated entirely by the deformation or expansion of the dome.

The compressive forces which can be encountered and accommodated by the elastic layer 8 at the transition surfaces between the water supply and withdrawal channels and the LRT-element are illustrated by arrows in FIG. 2.

The length and width of the LRT-elements, which are preferably manufactured in the factory, are such that they attain or nearly attain the acceptable values prescribed by the transporting vehicles. The length or height in the direction of the tubes is established by the economical optimum of 0.6 m to about 1 m.

For economical reasons the preferred material for the LRT-elements is a synthetic material, especially a thermoplastic synthetic resin, having adequate thermal stability and permanence of shape.

The fluid which flows through the tubes can be either air or an appropriate gas.

The present invention is, of course, in no way restricted to the specific disclosure of the specification and drawing, but also encompasses any modifications within the scope of the appended claims.

What we claim is:

1. A heat exchange element of the air-tube type for a heat exchanger unit; said heat exchange element being connected via flexible connecting lines with liquid supply and withdrawal channels having transition surfaces therebetween and which are otherwise separated from said element; together with said channels, said heat exchange element being supported on a support structure which has a relatively large open space between support members thereof; that dimension of said element measured in the longitudinal direction of said tubes thereof being relatively short; air flow occurring internally through said tubes, and liquid flow occurring externally around said tubes; said heat exchange element being disposed on said support members in such a way that it has a top side and a bottom side, upon one of which air impacts, and from the other of which air exits;

the improvement therewith which comprises: an arched dome on said top side and said bottom side of said heat exchange element being curved in a dish-shaped manner so that absorbing of thermal expansion of said heat exchange element occurs via deformation of said arched dome with which only compressive forces are generated at transition surfaces to liquid supply and withdrawal channels and said compressive forces can be readily absorbed without great difficulty, and said tubes of said heat exchange element being parallel so that when said heat exchange element is disposed on said support members, said tubes of said element extend substantially vertically, and substantially normal to said top side and said bottom side of said element due to elimination of any requirement for disposing said heat exchange element at an incline relative to horizontal relationship as is otherwise necessary for any parallelpipedal heat exchange element; said arched dome also increasing inherent rigidity of said heat exchange element therewith.

2. In a heat exchange element of the air-tube type for a heat exchanger unit of a cooling tower; said heat exchange element being connected via flexible connecting lines with liquid supply and withdrawal channels having transition surfaces therebetween and which are otherwise separated from said element; together with said channels, said heat exchange element being supported on a support structure which has a relatively large open space between support members thereof; that dimension of said element measured in the longitudinal direction of said tubes thereof being relatively short; air flow occuring internally through said tubes, and liquid flow occurring externally around said tubes; said heat exchange element being disposed on said support members having a top side and a bottom side therewith, upon one of which air impacts, and from the other of which air exits;

the improvement therewith which comprises: an arched dome extending axially via convexly-curved circular areas on said top side and said bottom side of said heat exchange element being curved in a dish-shaped manner so that absorbing of thermal expansion of said heat exchange element occurs via deformation of said arched dome with which only compressive forces are generated at transition surfaces to liquid supply and withdrawal channels and said compressive forces can be readily absorbed without great difficulty;

said heat exchange element being disposed on said support members, said tubes of said element extending substantially vertically, and substantially normal to said top side and said bottom side of said element due to elimination of any requirement for disposing said heat exchange element at an incline relative to horizontal relationship as is otherwise necessary for any parallelepipedal heat exchange element; said arched dome also increasing inherent rigidity of said heat exchange element therewith; said top side and said bottom side being formed by thicknesses of tube extensions as well as including side walls that are planar and uninterrupted;

an elastic layer of synthetic material which at least partially compensates for thermal expansion, said heat exchange element being surrounded by said elastic layer except in the region of said liquid supply and withdrawal passages that communicate with appropriate openings in side walls of the liquid supply and withdrawal channels; said heat exchange element including an intermediate layer on the suuport structure forming a lower portion with support surfaces for individual heat exchanger elements and associated liquid channels being disposed at the same level or height; and an outer shell of the cooling tower being in the form of a relatively thick concrete beam as well as a thinner tower shell extending above said concrete beam; the supply of air and removal from the heat exchange element being affected at a highest point of said arched dome.

* * * * *